US005777272A

United States Patent [19]

Rouskey

[11] Patent Number: 5,777,272

[45] Date of Patent: Jul. 7, 1998

[54] COLOR BANDED JACKET ASSEMBLY FOR AN ANTENNA FEED CABLE

[76] Inventor: Nick Rouskey, 423 SE. 18th Ter., Cape Coral, Fla. 33990

[21] Appl. No.: 745,651

[22] Filed: Nov. 12, 1996

[51] Int. Cl.[6] ..... H01B 7/36

[52] U.S. Cl. ..... 174/112; 174/45 R

[58] Field of Search ..... 174/105 R, 112, 174/114 S, 120 R, 120 C, 40 R, 45 R, 68.3, 136; 248/541, 219.3, 231.85

[56] References Cited

U.S. PATENT DOCUMENTS

| | | | |
|---|---|---|---|
| D. 14,451 | 11/1883 | Pond | 174/112 X |
| 2,133,448 | 10/1938 | Harley | 174/105 R X |
| 2,164,168 | 6/1939 | Wertzheiser et al. | 174/120 C X |
| 2,487,064 | 11/1949 | Marsh | 174/112 X |
| 2,629,953 | 3/1953 | Von Stackelberg et al. | 174/112 X |
| 2,960,561 | 11/1960 | Plummer | 174/36 |
| 3,038,205 | 6/1962 | Plummer | 18/47.5 |
| 3,060,069 | 10/1962 | Sindars | 154/45 |
| 3,233,853 | 2/1966 | Majewski | 248/219.1 X |
| 3,412,200 | 11/1968 | Lars-Goran Virsberg et al. | 174/120 R X |
| 3,568,308 | 3/1971 | Plaskon | 174/112 X |
| 3,650,862 | 3/1972 | Burr | 174/112 X |
| 3,926,141 | 12/1975 | Taylor | 116/114 R |
| 4,629,285 | 12/1986 | Carter et al. | 174/112 X |
| 4,656,767 | 4/1987 | Tarrant | 174/112 X |

FOREIGN PATENT DOCUMENTS

| | | | |
|---|---|---|---|
| 535163 | 11/1955 | Italy | 174/112 X |

*Primary Examiner*—Kristine L. Kincaid
*Assistant Examiner*—Dean A. Reichard
*Attorney, Agent, or Firm*—William E. Noonan

[57] ABSTRACT

A color banded jacket assembly is disclosed for use in combination with an antenna feed cable. The assembly includes a plurality of generally tubular first and second jacket segments, each having a split formed longitudinally therein. The antenna feed cable is selectively introduced into and removed from the jacket segments through the splits. Each jacket segment is sufficiently large to wrap at least partially about the periphery of a cable that is introduced into the jacket segment. A plurality of distinct first and second color bands are formed circumferentially about the first and second jacket segments, respectively. The first and second jacket segments are arranged longitudinally on the cable to mark the cable in an alternating color pattern. A method of marking an antenna feed cable through the use of such a color banded jacket is also disclosed.

18 Claims, 4 Drawing Sheets

COLOR BANDED JACKET ASSEMBLY FOR AN ANTENNA FEED CABLE

FIELD OF THE INVENTION

This invention relates to a color banded jacket assembly for an antenna feed cable and, more particularly, to a generally tubular, color banded jacket assembly that is attached to the antenna feed cable of a communication tower so that the cable is clearly marked and visible to aircraft flying in the vicinity of the tower.

BACKGROUND OF THE INVENTION

Governmental regulations now require that communication towers be plainly and distinctively marked so that they are visible to passing aircraft. Although some broadcast towers employ strobe lighting, many older and taller towers must also be painted according to a federally mandated color scheme. In particular, the Federal Aviation Administration (FAA) mandates that all exposed tower surfaces, with the exception of walkways and radiating elements of the antenna, be painted. This requirement extends to the coaxial or wave guide antenna feed cable that is operably attached to the antenna and mounted along the tower. Present regulations require the cable to include an alternating pattern of colored bands, comprising aviation orange and aviation white. The uppermost and lowermost bands must be orange. A minimum of seven bands must be employed and each band must have a width of at least 1.5 feet and not greater than 100 feet.

At present, alternating color bands are typically painted on both the communication tower and the antenna feed cable. Painting is obviously time and labor intensive. As a result, this procedure can be very expensive. Occasionally, the owner of a communication tower will neglect painting the antenna cable. This is permissible for cables that are hidden from view. However, in most communication towers the antenna feed cable is at least partially visible. In such cases, failing to apply the federally mandated color scheme creates a serious aircraft safety hazard. Omitting color bands from the cable can also subject the owner, as well as the owner's licensees, to substantial fines.

Even if the antenna feed cable is properly painted, a number of problems typically result. As previously indicated, considerable time, labor and expense are required to paint the cable. Moreover, antenna cables require fairly frequent maintenance. The cable is traditionally enclosed by a black plastic jacket, which is designed to resist deterioration from ultraviolet radiation. Black cable jackets also shed ice effectively in colder climates. Unfortunately, paint also resists sticking to and peels easily from such jackets. As a result, the cable normally must be repainted much more frequently than the remainder of the tower. Using a specially formulated paint that is more adherent to plastic surfaces would help address this difficulty. However, it is not economical or efficient for paint manufacturers to develop a separate paint specifically designed for use on antenna feed cables. Therefore, standard paint continues to be used on both the tower and the cable, which causes the problems described above.

SUMMARY OF INVENTION

It is therefore an object of the present invention to provide a color banded jacket assembly for an antenna feed cable of the type used in communication towers.

It is a further object of this invention to provide a jacket assembly that clearly marks antenna feed cables so that such cables fully comply with governmental regulations.

It is a further object of this invention to provide a jacket assembly which marks an antenna feed cable with an alternating pattern of color bands so that the cable is plainly visible to passing aircraft.

It is a further object of this invention to provide a jacket assembly, which properly marks an antenna feed cable with alternating color bands without having to paint such bands on the cable, and which eliminates the problems that accompany such painting.

It is a further object of this invention to provide a color banded jacket assembly for an antenna cable, which significantly reduces the time, labor and expense that are typically associated with marking such cables according to federal regulations.

It is a further object of this invention to provide an assembly for color banding an antenna feed cable, which is more durable and which requires less frequent refurbishing and maintenance than are required by standard painted antenna cables.

It is a further object of this invention to provide a color banded jacket assembly for an antenna feed cable, which is quick and easy to install or replace, and which may be conveniently wound on large reels and cut to custom fit various lengths of antenna cable.

This invention results from a realization that coaxial and wave guide antenna feed cables, of the type commonly used in communication towers, can be effectively marked to meet federal regulations by fitting the cable with a split, generally tubular jacket that comprises a plurality of circumferential color banded segments arranged longitudinally on the jacket in an alternating color pattern. Using such a jacket, the required alternating color pattern may be quickly and securely attached to the antenna feed cable without painting or the problems that usually accompany such painting.

This invention features a color banded jacket assembly for use in combination with an antenna feed cable. The assembly includes a plurality of generally tubular first jacket segments. Each first jacket segment includes a longitudinal split through which an antenna feed cable is selectively introduced into and removed from the first jacket segment. The first jacket segment is sufficiently large to wrap at least partly about the cable. A band comprising a first color is formed circumferentially about the first jacket segment. The assembly also includes a plurality of generally tubular second jacket segments. Each includes a longitudinal split through which the antenna cable is selectively introduced and removed from the second jacket segment. Each second jacket segment is sufficiently large to wrap at least partly about the cable and further includes a band comprising a distinct second color formed circumferentially about the second jacket segment. The first and second jacket segments are arranged longitudinally alternately on the cable to mark the cable with an alternating color pattern.

In a preferred embodiment, each jacket segment is separate and distinct from each other jacket segment. The first and second jacket components may be arranged end to end on the cable. Each jacket segment may include a flexible material and may specifically include resilient means for urging the jacket segment into gripping interengagement with a cable about which the jacket segment is wrapped. The resilient means urge the split to maintain a width that is normally narrower than the diameter of a cable used in combination with the jacket assembly. The resilient means permit the jacket segment to be expanded and the split to be widened sufficiently to selectively introduce the cable into and remove the cable from the jacket segment through the split. The split may extend for the entire length of the jacket segment and may comprise a narrow, longitudinal slit. The jacket segment may include a pair of longitudinal edges that define the slit. The resilient means may urge the longitudinal edges to interengage one another, at least before a cable is introduced into the jacket segment. Means may be disposed peripherally about the jacket segment for securing the jacket segment to a cable about which the jacket segment is wrapped. The jacket segments may carry a scale that indicates the length of each segment.

The color bands may include a first set of generally annular bands having a first color and a second set of generally annular bands having a second color. The first and second sets of bands are arranged longitudinally on the jacket component in an alternating pattern wherein each band of the first color is disposed adjacent at least one band of the second color and each band of the second color is disposed adjacent to at least one band of the first color. The color bands may include first and second colors exclusively. The first and second colors are preferably white and orange. The color bands are typically formed by dying the jacket component in the selected alternating colors. Each color band may have a width of at least 1.5 feet and not greater than 100 feet. Preferably, at least seven color bands are arranged on the jacket.

A method is also provided for marking an antenna feed cable to increase the visibility of the cable to aircraft flying in the vicinity of the cable. The method includes providing elongate, generally tubular first and second jacket components, each having a respective color and a split formed longitudinally therein. These components are cut longitudinally into respective pluralities of first and second segments having predetermined lengths. The segments are attached to the antenna feed cable in a longitudinally alternating pattern by introducing the cable alternately through respective longitudinal splits in the first and second jacket segments to wrap each jacket segment at least partly about the periphery of the cable and mark the cable in an alternating first and second color pattern.

Preferably, each jacket component includes resilient means that urge the split so that it is normally more narrow than the diameter of the cable. The method may include the steps of progressively spreading the jacket component and widening the split in a longitudinal direction and progressively introducing the cable in a longitudinal direction into the widened split. The jacket component may be clamped to the cable proximate longitudinal ends of the jacket component. The cable and the clamped jacket component may be mounted to a broadcast tower structure. Finally, the method may include the step of installing a bracket, which bracket includes a first portion that is attached to the broadcast tower and a second portion that is clamped peripherally about both the cable and the jacket component wrapped about the cable.

BRIEF DESCRIPTION OF THE DRAWINGS

Other objects, features and advantages will be apparent from the following description of preferred embodiments and the accompanying drawings, in which.

DETAILED DESCRIPTION OF PREFERRED EMBODIMENTS

Figure 1:
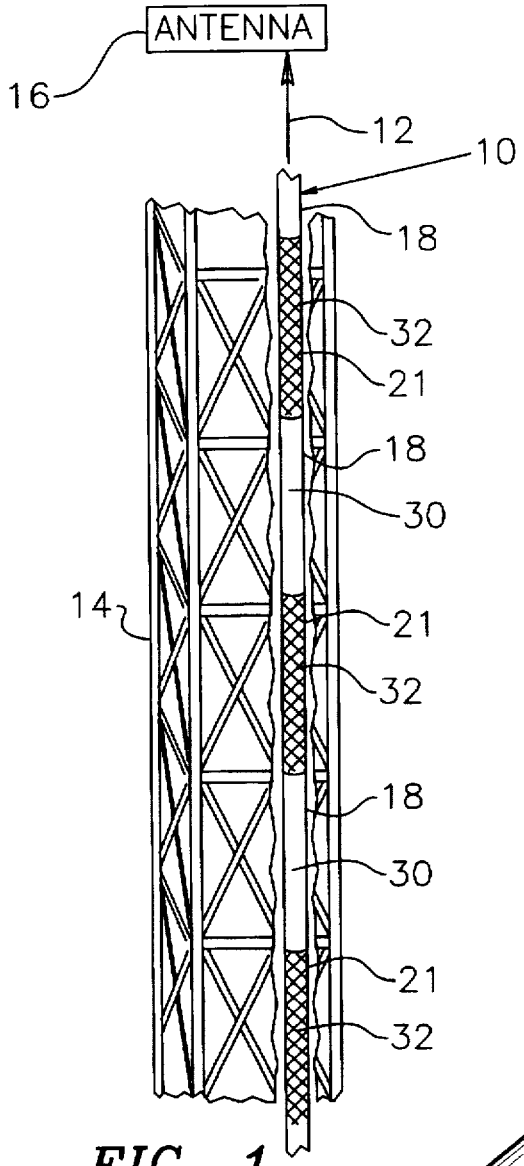
FIG. 1 is a perspective, partially cut away view of an antenna feed cable installed in a standard broadcast communication tower and equipped with the color banded jacket assembly of this invention.

There is shown in FIG. 1 a color banded jacket assembly 10 that is used for properly marking an antenna feed cable according to governmental requirements. The cable, which is represented schematically in FIG. 1 by arrow 12, is a standard coaxial or wave guide antenna feed cable of the type well known for use in broadcast communication towers. Such towers employ an elongate tower 14, only a section of which is illustrated in FIG. 1. Tower 14 may have various heights and be built according to various known techniques. Furthermore, the tower may be painted or otherwise marked in a conventional manner. A standard communications antenna 16 (represented schematically) is mounted proximate the upper end of tower 14. Cable 12 is operably interengaged to antenna 16 and mounted to tower structure 14. The specific structural details of the communication tower, the antenna and the antenna feed cable should be well understood to those skilled in the art and do not comprise a part of this invention. Antenna Cable 12, and attached jacket assembly 10 are mounted to tower 14 by various means of attachment. A particularly preferred form of attachment, which is well suited for use in connection with the present invention, is described more fully below.

Jacket assembly 10 includes a plurality of elongate, generally tubular first jacket segments 18 and a plurality of similarly constructed second jacket segments 21. A representative jacket segment 18 is shown alone in FIG. 2. Jacket segments 21 have virtually identical features, with the only difference being surface coloring. In particular, a central opening 19 formed through the jacket segment accommodates the antenna cable. Each jacket segment comprises a lightweight, yet durable plastic material. Various known plastics may be employed. The jacket segment should be water resistant and capable of being dyed according to a governmentally approved color band pattern, which will be described more fully below. Jacket segment 18 typically includes a resiliently flexible material and is manufactured according to various known extrusion and molding techniques.

Figure 2:
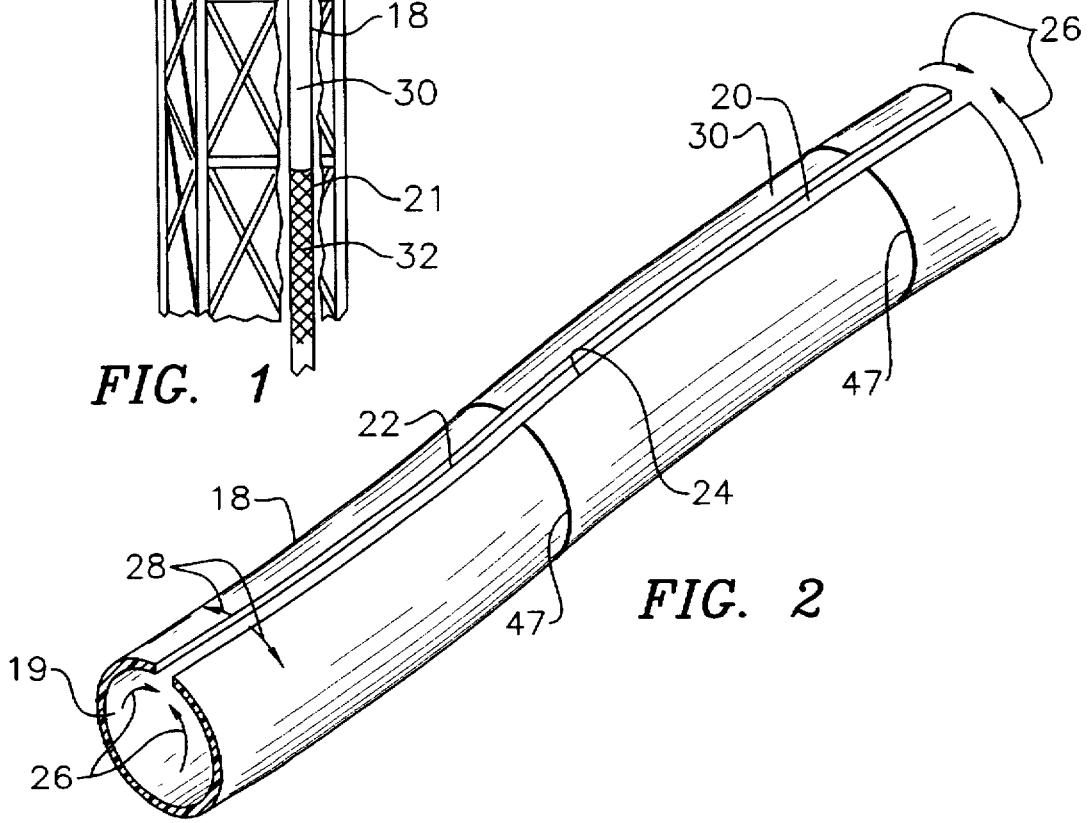
FIG. 2 is a perspective view of a representative jacket segment used in the assembly of this invention.

A longitudinal split 20 is formed in each jacket segment. This split is typically created by simply slicing or cutting the jacket segment along its entire length. Split 20 may be formed either during the process of manufacturing the jacket segment itself or, alternatively, after the jacket segment is fully formed. In either event, split 20 is defined by longitudinal edges 22 and 24. In FIG. 2, split 20 includes a noticeable gap. Alternatively, the resilient composition of the jacket segment may urge the longitudinal edges 22 and 24 together, as indicated by arrows 26, such that those edges define an extremely narrow longitudinal slit. The edges may touch, overlap or be spaced a minute distance apart from one another. By the same token, the resilient composition of jacket segment 18 permits the longitudinal edges 22 and 24 to be spread apart, as indicated by arrows 28, so that split 20 may be selectively widened.

As illustrated in FIGS. 1 and 2, an annular white band 30 is formed circumferentially about each jacket segment 18. Similarly, a second orange band 32 is formed circumferentially about each jacket segment 21. The colored bands completely cover the outer circumferential surfaces of their respective jacket segments. White bands 30 and orange bands 32 are formed permanently about jacket segments 18 and 21. Tubular jacket segments 18 and 21 and therefore color bands 30 and 32, are wrapped about and arranged longitudinally end to end on cable 12 in an alternating pattern. As a result, white and orange bands 30 and 32 are formed immediately adjacent one another and the colors alternate along the length of the jacket assembly 10. See FIG. 1. According to present governmental regulations, the orange bands 32 are formed at the longitudinal ends of the jacket assembly. See also FIG. 4. Accordingly, each white band 30 is disposed between two orange bands. Similarly, other than the two orange bands located at the respective longitudinal ends of assembly 10, each remaining orange band is formed between two white bands. Each band preferably has a width of at least 1.5 feet and not greater than 100 feet. In a typical communications tower, at least seven of these bands are formed. The color bands 30 and 32 are formed by dying the jacket segments 18 and 21 according to the governmentally required pattern. The jacket segments may be dyed according to various known processes. Alternatively, the color bands may be formed about the respective jacket segments by other types of coloring techniques. To provide adequate visibility and warning to aircraft, aviation orange and aviation white are preferably employed. It should be understood that, although orange and white bands are typically used to conform to the modified specifications described above, this particular color sequence and the remaining specifications of the color banding may be varied within the scope of this invention. In particular, other color patterns, dimensional specifications and number requirements for the color bands may be dictated or permitted by governmental rules and regulations. The jacket assembly of this invention is intended to cover all varieties of alternating color band patterns that may be employed on a cable jacket assembly.

Figure 3:
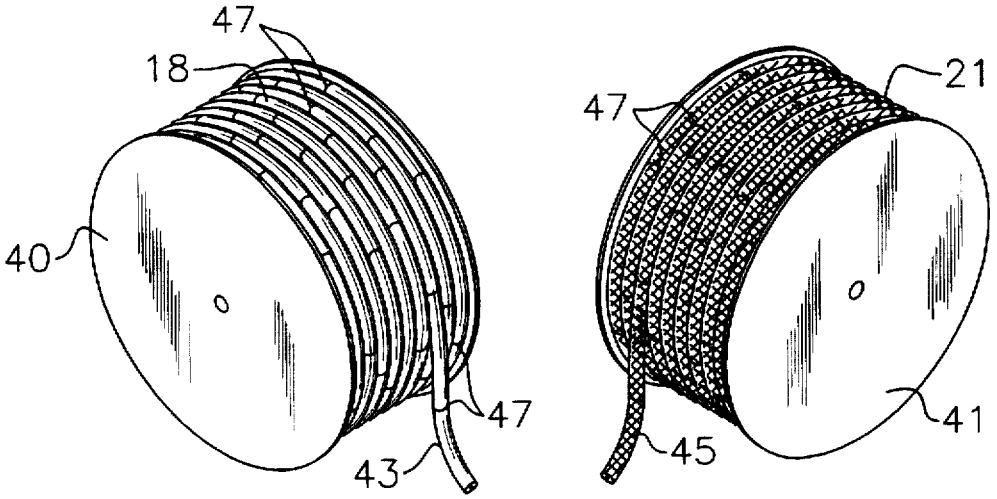
FIG. 3 is a perspective view of a pair of reels carrying respective wound supplies of orange and white jacket segments that are cut in predetermined lengths and installed in an alternating pattern on an antenna feed cable, in accordance with this invention.

As shown in FIG. 3, before the jacket assembly is installed on a cable, the tubular jacket segments 18 and 21 are wound in continuous strips on respective reels 40 and 41. In particular, the jacket segments 18 define an elongate tubular component 43, which has a white outer surface, and jacket segments 21 define an elongate tubular component 45, which has an orange outer surface. Each of tubular components 43 and 45 features the construction and shape illustrated in FIG. 2. Each wound jacket component typically has an initial length of hundreds of feet. Each component 43, 45 also carries a scale comprising a plurality of transverse indicia or markings 47 that are formed at regular intervals along the tubular component. Indicia 47 are typically formed at standard intervals such as each foot, yard or meter. The scale permits predetermined lengths of the tubular jacket components to be conveniently measured and cut into the individual jacket segments that are used in jacket assembly 10. Specifically, jacket component 47 on reel 40 is used to generate the jacket segments 18 and jacket component 45 on reel 41 yields the jacket segments 21. This procedure is described more fully below.

Figure 4:
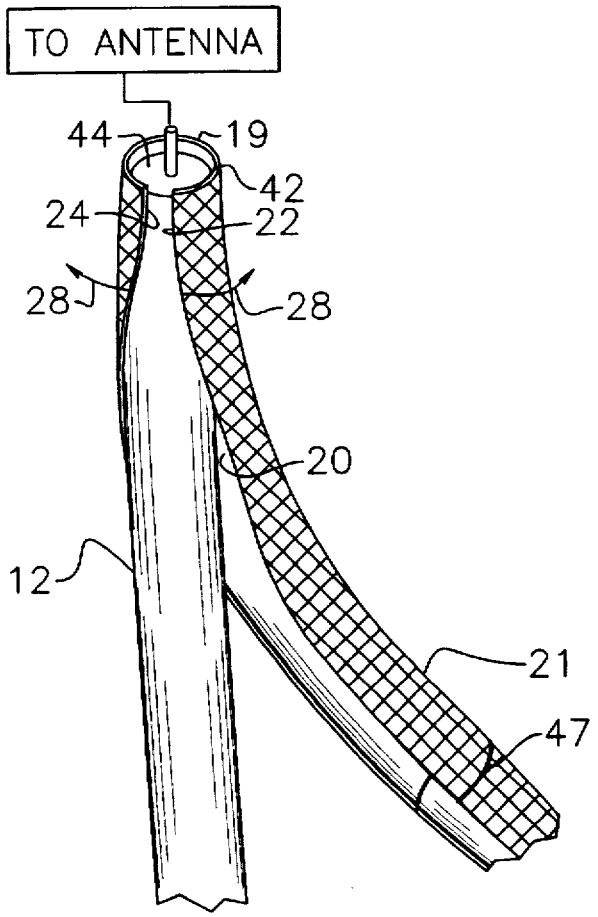
FIG. 4 is a perspective view of an antenna feed cable being introduced into a respective jacket segment through the longitudinal split in the jacket segment proximate one end of that split.

The jacket assembly is installed on the antenna feed cable either before or after the cable is mounted in the communication tower. Installation is performed prior to mounting the cable in the tower in cases where the tower is being newly constructed or a new cable is being installed. Alternatively, assembly 10 may be retrofit on a cable already mounted in an existing tower. In either case, the length of cable 12, FIGS. 1 and 4, is first measured. Based upon this measurement, the installer determines the number of jacket segments 18 and 21 that will be required, as well as the respective lengths of those segments. To make this determination, the installer utilizes the governmentally mandated specifications for marking the antenna cable. Specifically, a minimum of seven distinct color bands must be used and each band must have a width of between 1.5 feet and 100 feet. Additionally, the uppermost and lowermost bands must be orange (i.e. jacket segment 21 must be used). The alternating jacket segments 18, 21 and associated bands 30 and 32 should be as wide as possible (within the 100 foot maximum) to provide optimum visibility. As an example, if the antenna cable measures 300 feet, seven jacket segments are utilized and each segment preferably has a width of 42.85 feet. For antenna cables in excess of 700 feet, more than seven bands must be employed. In such cases, an odd number of bands are featured because the uppermost and lowermost bands must be orange. For cables shorter than 700 feet, seven color bands are employed. Preferably the widths of the bands are coequal, although the upper and lower bands may have differing widths in some installations.

After the number of bands and the width of each band is determined, the installer obtains the corresponding jacket segments 18 and 21 from reels 40 and 41, respectively. Specifically, successive predetermined lengths of jacket component 43, are deployed from reel 40 and cut to provide individual jacket segments 18, FIGS. 1 and 2. Each jacket segment 18 carries a white band 30 and corresponds in length to the predetermined width of a respective white band. Similarly, component 45 is unwound from reel 41 and cut in predetermined lengths to provide orange banded jacket segments 21 having corresponding, predetermined band widths. The actual lengths of jacket segments that are cut may, in some cases, be slightly greater than the predetermined color band widths. This allows the adjacent color bands to overlap somewhat when the jacket segments are installed on the antenna cable in the manner described below. The scale 47 formed on the tubular components 43 and 45 allows the individual jacket segments to be quickly and precisely measured and cut so that the required lengths and color band widths are accurately obtained.

Figure 5:
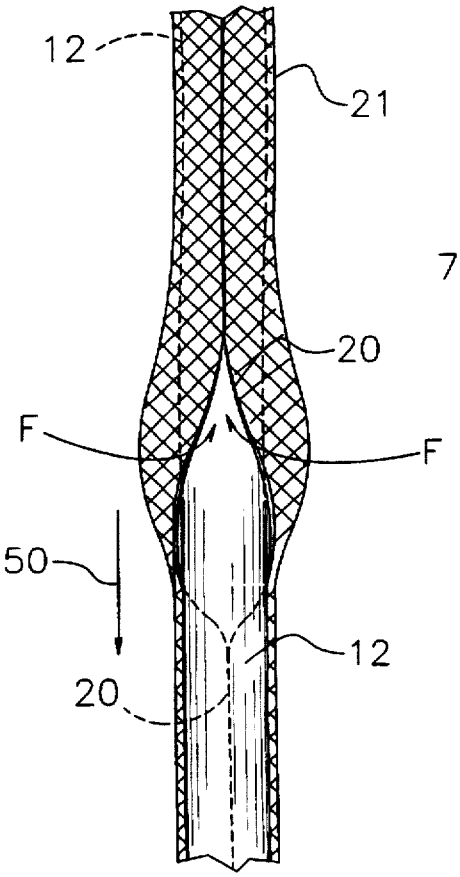
FIG. 5 is an elevational view of the cable being progressively pressed against and introduced into the jacket segment at a position spaced longitudinally apart from the position being introduced in FIG. 4.

The jacket segments are installed on the antenna cable in the manner shown in FIGS. 4 and 5. As previously indicated, to conform with governmental requirements, the leading end 42 of the end jacket segment 21 should comprise an orange band 32. End 44 of cable 12 is pressed against the jacket split 20 proximate jacket end 42. This causes the longitudinal edges 22 and 24 of jacket segment 21 to spread apart in the manner shown by arrows 28. As a result, split 20 widens so that end 44 of cable 12 is introduced through the split into opening 19 of jacket segment 21. Before the cable is pressed against the split, jacket segment 21 urges split 20 to maintain a width that is narrower than the diameter of cable 12. The resilient composition of the plastic jacket segment permits segment 21 to be expanded and split 20 to be widened sufficiently to selectively introduce the cable into the orange banded jacket segment. As illustrated in FIG. 5, the installer continues to press cable 12 in a progressively longitudinal manner against split 20, in the manner indicated by arrows F. This progressively spreads the jacket segment and widens the split in a longitudinal direction indicated by arrow 50, so that cable 12 is gradually introduced in a longitudinal direction into the jacket segment 21 through the widening split 20. The installer continues to press the cable into the jacket in this manner until the entire length of segment 21 is wrapped about cable 12. See FIG. 6. As the cable is progressively installed in jacket segment 21, in the manner shown in FIGS. 4 and 5, the resilient composition of the jacket segment urges segment 21 into gripping interengagement with cable 12. The widened split resumes its narrow, slit-like appearance. See FIG. 6. A pair of tie wraps 60 and 61 may be wrapped about the upper and lower ends respectively of segment 21 and twisted closed. This securely fastens the jacket segment to the cable and prevents segment 21 from disengaging the cable during installation of the cable and jacket into the tower.

A white banded jacket segment 18 is attached to cable 12 in an analogous manner and positioned immediately adjacent segment 21. Tie wraps 65 and 67 are again used to improve the interengagement of the jacket segment and the cable. Successive alternating segments 21 and 18 are similarly attached to cable 12, in each instance by introducing the cable into the jacket segment through its longitudinal split. This process is repeated until all or virtually all of the cable is enclosed by the color banded jacket segments. As a result, the antenna feed cable is properly marked by alternating orange and white color bands that extend for the length of jacket assembly 10.

The jacket assembly may be attached to a particular length of cable 12 in either multiple segments, as just described, or a single continuous piece. For example, discrete, alternating orange and white bands may be formed on a one-piece tubular component 18.

Figure 6:
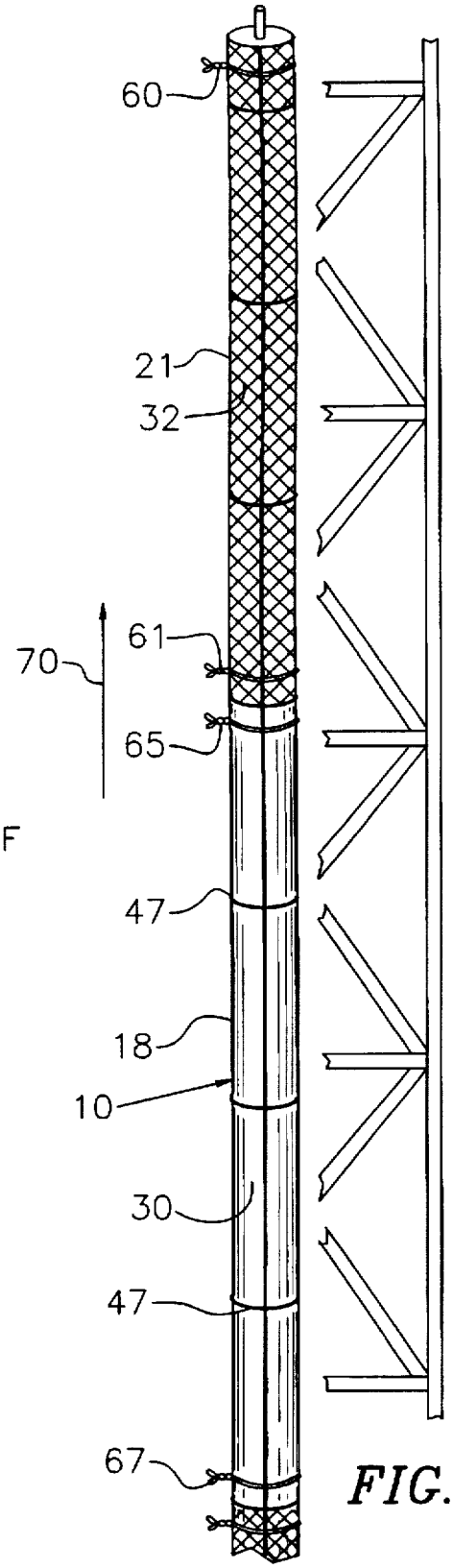
FIG. 6 is an elevational view of the antenna feed cable being raised in a tower with the jacket assembly provisionally attached to the cable and tie wrap fastening components wrapped about each jacket segment so that the jacket segments remain securely in place about the cable.

As previously indicated, jacket assembly 10 may be attached to cable 12 either prior to or following installation of the cable in the communication tower. For new installations, the jacket is preferably secured to cable 12 on the ground, or from the ground up, as the cable is installed in the tower. FIG. 6 illustrates a representative manner in which a cable 12 and attached jacket assembly 10 are installed together in communication tower 14. Initially, a predetermined number of precut jacket segments 18 and 21 are attached to cable 12, on the ground and in the manner previously described. Next, the jacket segments are securely fastened to the cable proximate the upper and lower ends of each discrete, elongate section of the jacket. This is specifically accomplished by respective pairs of upper and lower tie wrap elements 60, 61 and 65, 67. The tie wrap fasteners hold the jacket component in secure interengagement with the cable while the cable and jacket component are raised within the tower, in the manner indicated generally by arrow 70. Without these fasteners, jacket segments 18 and 21 may be dislodged from the cable as the cable and jacket segments are raised and installed within tower 14. Otherwise, the cable and attached jacket segments are raised and installed in the tower structure in a conventional manner similar to that which has been used for installing just the antenna feed cable in the communication tower. In certain versions, jacket segments 18 and 21 may have sufficient resilience and spring bias such that they adequately grip the enclosed cable during installation without the need for a tie wrap or other types of fasteners.

The jacket assembly may also be retrofit to cables in existing broadcast communication towers. In these situations, the installer progressively attaches jacket segments 18 and 21 to cable 12 from the upper, antenna end of the cable in a downward direction toward the ground. This procedure is best illustrated in FIGS. 4 and 5 wherein the jacket segment 21 is first attached to cable 12 at an upper end 44 proximate the antenna. Additional white and orange jacket segments 18 and 21 are then progressively and alternately engaged with cable 12 such that those segments extend in an end to end arrangement for the length of the cable. In this manner the cable is properly marked with the required alternating color band pattern.

Figure 7:
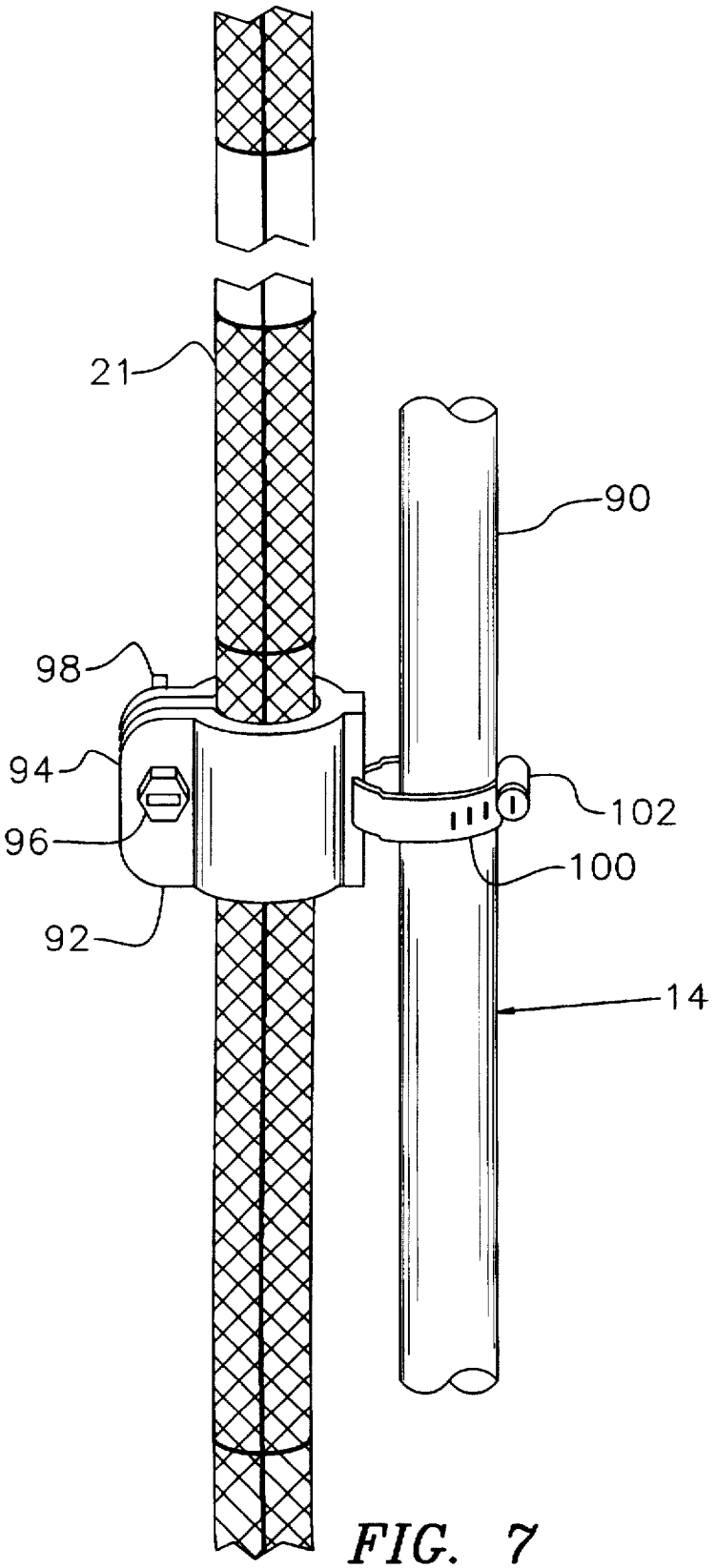
FIG. 7 is a perspective view of a bracket component, which clamps the broadcast antenna cable and its attached color banded jacket assembly to a structural component of the broadcast communication tower.

As shown in FIG. 7, the antenna feed cable and an attached color banded jacket segment 21 are secured to a structural component 90 of tower structure 14 by a hanger or bracket mechanism 92. A number of these brackets may be used. Typically, at least one bracket mechanism is employed for each jacket segment carried by cable 12. In FIG. 7, for clarity, only one bracket mechanism 92 is illustrated. Each bracket mechanism 92 includes a cable clamp 94. A screw 96 extends through opposing flanges of the clamp and operably engages a complementary nut 98. The screw is selectively loosened and tightened to open and close the clamp, as required. Bracket 92 also includes a hose clamp 100 that is attached to cable clamp 94. A threaded adjustment screw 102 selectively reduces and enlarges the diameter of clamp 100 in a conventional manner. In existing installations, bracket 92 may comprise the standard bracket which is already used to secure the cable to the tower structure. In such cases, the bracket mechanisms 92 must first be successively removed so that the jacket segment can be installed on the cable in the manner described above. In new tower installations, the cable and attached jacket segments are raised before the bracket mechanisms are attached. See FIG. 6. In either embodiment, cable 12 and attached jacket segments 18 and 21 are positioned properly in place within tower 14, for example, adjacent to component 90, FIG. 7. Bracket mechanisms 92 are then installed to secure both the cable and the attached jacket segments to the tower. Specifically, hose clamp 100 is fastened to structural tower component 90 at a desired location. Adjustment screw 102 is then tightened to secure the bracket mechanism to the tower structure. Screw 96 and nut 98 are disengaged from cable clamp 94 and that clamp is wrapped about and engaged with a respective jacket segment (representative segment 21 in FIG. 7) and the enclosed cable 12. Screw 96 and nut 98 are then reattached to clamp 94. The screw is retightened so that clamp 94 securely grips the tubular jacket segment and enclosed cable. As a result, the jacket segment is held in secure interengagement against the cable and, at the same time, both the jacket segment and cable are securely mounted to the tower structure. Any number of additional bracket mechanisms may be employed in this manner and the bracket mechanisms or analogous types of fasteners may be positioned at various locations along the tower.

The color banded jacket of this invention allows all types of antenna feed cables to be clearly marked so that they are plainly visible and provide warnings to passing aircraft. The above described installation is much quicker, less labor intensive and far less expensive than existing methods of painting the antenna feed cable. As a result, tower owners and licensees have a much greater incentive to comply with governmental tower marking requirements and avoid expensive penalties. The plastic composition of the jacket component is durable and long-lasting. At the same time, it resists the build up of ice. Although the color bands carried by the jacket assembly remain effective far longer than conventionally painted bands, eventually some deterioration will likely occur. In such cases, the jacket assembly of this invention can be quickly, conveniently and inexpensively replaced. This is accomplished simply by spreading the longitudinal edges of each jacket segment and widening the split so that the cable can be removed from the jacket segment through the widened split. In most cases, removal is accomplished simply by successively pulling each jacket segment off of the cable such that the cable passes through the split in the tubular jacket segment. A fresh segment or length of the color banded jacket segment may then be reattached to the cable in the manner previously described.

Although specific features of the invention are shown in some drawings and not others, this is for convenience only, as each feature may be combined with any or all of the other features in accordance with the invention. Other embodiments will occur to those skilled in the art and are within the scope of the following claims.

What is claimed is:

1. A color banded jacket assembly in combination with an antenna feed cable, said assembly comprising:

a plurality of generally tubular, one-piece first jacket segments, each including a longitudinal split through which an antenna feed cable is selectively introduced into and removed from the first jacket segment, each said first jacket segment being sufficiently large to wrap at least partially about the cable and further including a band of a first color exclusively, which is formed circumferentially about said first jacket segment; and a plurality of generally tubular, one-piece second jacket segments, each including a longitudinal split through which the antenna cable is selectively introduced into and removed from the second jacket segment, each said second jacket segment being sufficiently large to wrap at least partially about the cable and further including a band of a distinct second color exclusively, which is formed circumferentially about said second jacket segment; each said jacket segment being composed of a flexibly resilient material that urges said split to maintain a width that is normally more narrow than the diameter of the cable, said resilient material permitting said jacket segment to be expanded and said split to be widened sufficiently to selectively introduce the cable into and remove the cable from the jacket segment through the split, said resilient material urging said jacket segment into gripping interengagement with the cable about which said jacket segment is wrapped;

each said jacket segment being separate and distinct from each other jacket segment and said first and second jacket segments being arranged alternately along the cable to mark the cable with an alternating color pattern.

2. The assembly of claim 1 in which said first and second jacket segments are arranged end to end in said alternating pattern on the cable.

3. The assembly of claim 1 further including a scale means carried by said jacket segments for indicating the length of each said segment.

4. The assembly of claim 1 in which each said split includes a pair of longitudinal edges that define said split, said resilient material urging said longitudinal edges to interengage one another, at least before the cable is introduced into said jacket segment.

5. The assembly of claim 1 further including means disposed peripherally about each of said jacket segments for securing said jacket segment to the cable about which said jacket segment is wrapped.

6. The assembly of claim 1 in which each said band has a width of at least 1.5 feet and not greater than 100 feet.

7. The assembly of claim 1 wherein at least seven of said jacket segments are arranged on the cable.

8. The assembly of claim 1 in which each said jacket segment includes a substantially uniform shape and interior diameter.

9. The assembly of claim 1 in which said flexibly resilient material urges each said jacket segment into gripping interengagement with the cable along substantially the entire length of said jacket segment.

10. The assembly of claim 1 in which said first and second jacket segments are arranged on the cable such that each band of said first color is disposed adjacent at least one band of said second color and each band of said second color is disposed adjacent to at least one band of said first color.

11. The assembly of claim 10 in which said first and second colors are white and orange.

12. A method of marking an antenna feed cable to increase the visibility of the cable to aircraft flying in the vicinity of the cable, said method comprising:

providing, in a continuous one-piece strip, a first elongate, generally tubular jacket component that has a first color exclusively and a split formed longitudinally therein;

providing, in a continuous one-piece strips a separate and distinct second elongate, generally tubular jacket component with a distinct second color exclusively and a split formed longitudinally therein;

cutting each of said first and second components transversely into respective pluralities of first and second jacket segments having predetermined lengths;

attaching respective ones of said first and second jacket segments to the cable in a longitudinally alternating pattern by introducing said cable alternately through respective splits in said first and second jacket segments to wrap each said jacket segment at least partially about a periphery of the cable and mark the cable in an alternating first and second color pattern.

13. The method of claim 12 further including the step of clamping each said jacket segment to said cable proximate longitudinal ends of the jacket segment.

14. The method of claim 12 in which said continuous one-piece strips are wound on respective reels, said strips being selectively unwound from said reels such that said predetermined lengths of said first and second jacket segments may be cut from said respective first and second components, respectively.

15. The method of claim 12 further including the steps of mounting the cable and the jacket segments to a broadcast tower structure.

16. The method of claim 15 further including the step of installing a bracket including a first portion that is attached to the broadcast tower structure and a second portion that is clamped peripherally about both the cable and a respective one of said jacket segments wrapped about the cable.

17. The method of claim 12 in which each said jacket segment is composed of a flexibly resilient material that urges said split to have a width that is more narrow than the diameter of the cable and further including the steps of progressively spreading each said jacket segment and widening said split in a longitudinal direction and progressively introducing the cable in a longitudinal direction into said jacket segment, said resilient material urging each said jacket segment into gripping interengagement with the cable about which said jacket segment is wrapped.

18. The method of claim 19 in which each said jacket segment includes a substantially uniform shape and inner diameter and wherein each said jacket segment grips the cable about which said jacket segment is wrapped along substantially the entire length of said jacket segment.

* * * * *